US007628661B2

(12) United States Patent
Liao

(10) Patent No.: US 7,628,661 B2
(45) Date of Patent: Dec. 8, 2009

(54) ELECTRICAL CONTACT

(75) Inventor: Chi-Nan Liao, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/384,077

(22) Filed: Mar. 31, 2009

(65) Prior Publication Data

US 2009/0247023 A1 Oct. 1, 2009

(30) Foreign Application Priority Data

Mar. 31, 2008 (TW) ..... 97205445 U

(51) Int. Cl.
*H01R 4/50* (2006.01)

(52) U.S. Cl. ..... 439/862

(58) Field of Classification Search ..... 439/862, 439/342, 832, 733.1, 83, 66, 876, 82, 751
See application file for complete search history.

(56) References Cited

U.S. PATENT DOCUMENTS 4,795,379 A * 1/1989 Sasaki et al. ..... 439/856
5,641,945 A * 6/1997 Abe et al. ..... 174/261
5,653,598 A 8/1997 Grabbe
5,730,608 A * 3/1998 Legrady ..... 439/78
6,669,499 B2 * 12/2003 Whyne et al. ..... 439/342
6,905,377 B2 6/2005 Murr
6,932,660 B2 * 8/2005 Roepke ..... 439/856
7,303,421 B2 * 12/2007 Liao ..... 439/342
7,367,814 B2 * 5/2008 Liao ..... 439/71
7,429,200 B2 * 9/2008 Lee et al. ..... 439/862
2008/0160841 A1 * 7/2008 Polnyi et al. ..... 439/842
2008/0160842 A1 * 7/2008 Polnyi et al. ..... 439/862

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

An electrical contact (100) for connecting an electronic package with a circuit substrate comprise a first part (1) and a second part (2). The first part (1) comprises a body portion (11) and a first spring arm (14) extending upwardly from the body portion (11), the first spring arm (14) defines a first contacting portion (141) at top end thereof. The second part (2) comprises a retention portion (21), a second spring arm (23) extending upwardly from the retention portion (21) and a solder portion (22) extending downwardly from the retention portion (21), the second spring arm (21) defines a second contacting portion (231) at top end thereof and the body portion (11) is fastened on the retention portion (21).

20 Claims, 6 Drawing Sheets

ELECTRICAL CONTACT

BACKGROUND OF THE INVENTION

1. Field of the Invention

The present invention relates to an electrical contact, and more particularly to an electrical contact for electrically connecting a package and a circuit substrate, and having two separated part assembled together which can provide two contacting points for the package.

2. Description of the Prior Art

Electrical connectors for removably mounting an LGA package on a PCB are known as LGA sockets. An LGA socket typically comprises a substantially flat dielectric housing which is positioned between the LGA package and the PCB. The housing defines an array of passageways with electrical contacts received therein in correspondence with the array of pads of the LGA package. Each contact has a pair of oppositely extending free ends spaced apart with a predetermined distance in an original position. The two free ends extend beyond the housing for respectively engaging with corresponding contacting pads on a bottom surface of the LGA package and on a top surface of the PCB thereby establishing an electrical connection between the LGA package and the PCB.

Various electrical contacts for LGA sockets are disclosed in the prior art, such as U.S. Pat. Nos. 5,653,598 issued to Dimitry on Aug. 5, 1997 and 6,905,377 issued to Keith on Jun. 14, 2005. Typically, a contact for an LGA socket comprises a single contacting portion at an upper end thereof and a single soldering portion at a bottom end thereof. The single contacting portion extends upwardly beyond an upper face of the socket to contact with a corresponding contacting pad of an LGA package. The single soldering portion extends downwardly beyond a lower face of the socket to contact with a corresponding solder pad of a PCB. Therefore, an electrical connection is established between the single contacting portion of the LGA package and a corresponding soldering pad of the PCB via a single contacting portion.

However, as the pads of the LGA package are increasing and the socket is reduced in size because of quick development of science, there is limited space for arranging the array of increasing contacts. Contacts for an LGA socket are usually designed in a trend of miniaturization; such will increase impedance of transmitting signal. Furthermore, the pads of the PCB must also be increased as the increasing pads of the LGA package and such increases the cost of the PCB manufacture. Thus, an improved contact for an LGA socket is required to overcome the disadvantages of the conventional contact.

In view of the above, a new electrical contact that overcomes the above-mentioned disadvantages is desired.

SUMMARY OF THE INVENTION

Accordingly, an object of the present invention is to provide an electrical contact having two separated part assembled together and each having a contacting portion connecting with the package.

To fulfill the above-mentioned object, an electrical contact comprises a first part and a second part. The first part comprises a body portion and a first spring arm extending upwardly from the body portion, the first spring arm defines a first contacting portion at top end thereof. The second part comprises a retention portion, a second spring arm extending upwardly from the retention portion and a solder portion extending downwardly from the retention portion, the second spring arm defines a second contacting portion at top end thereof and the body portion is fastened on the retention portion.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
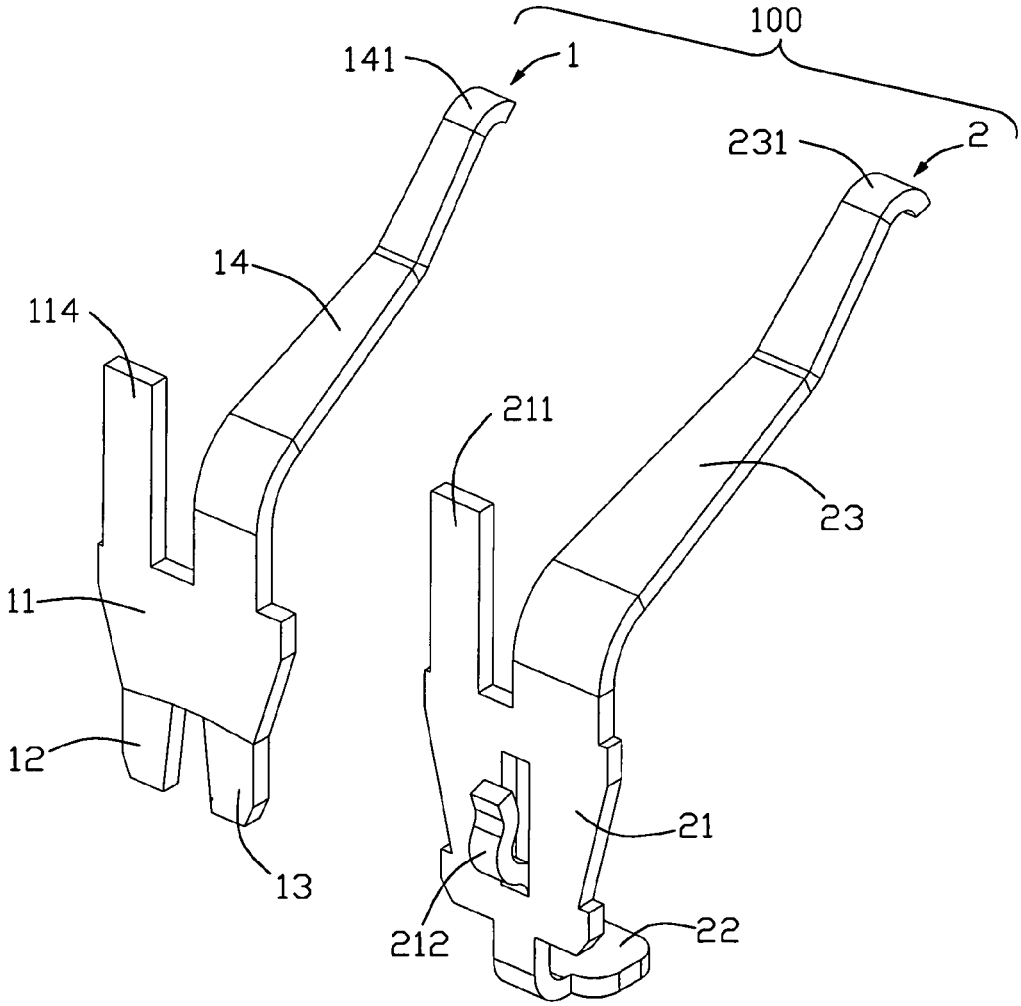
FIG. 1 is an exploded view of an electrical contact in accordance with the first embodiment of the present invention.
Figure 3:
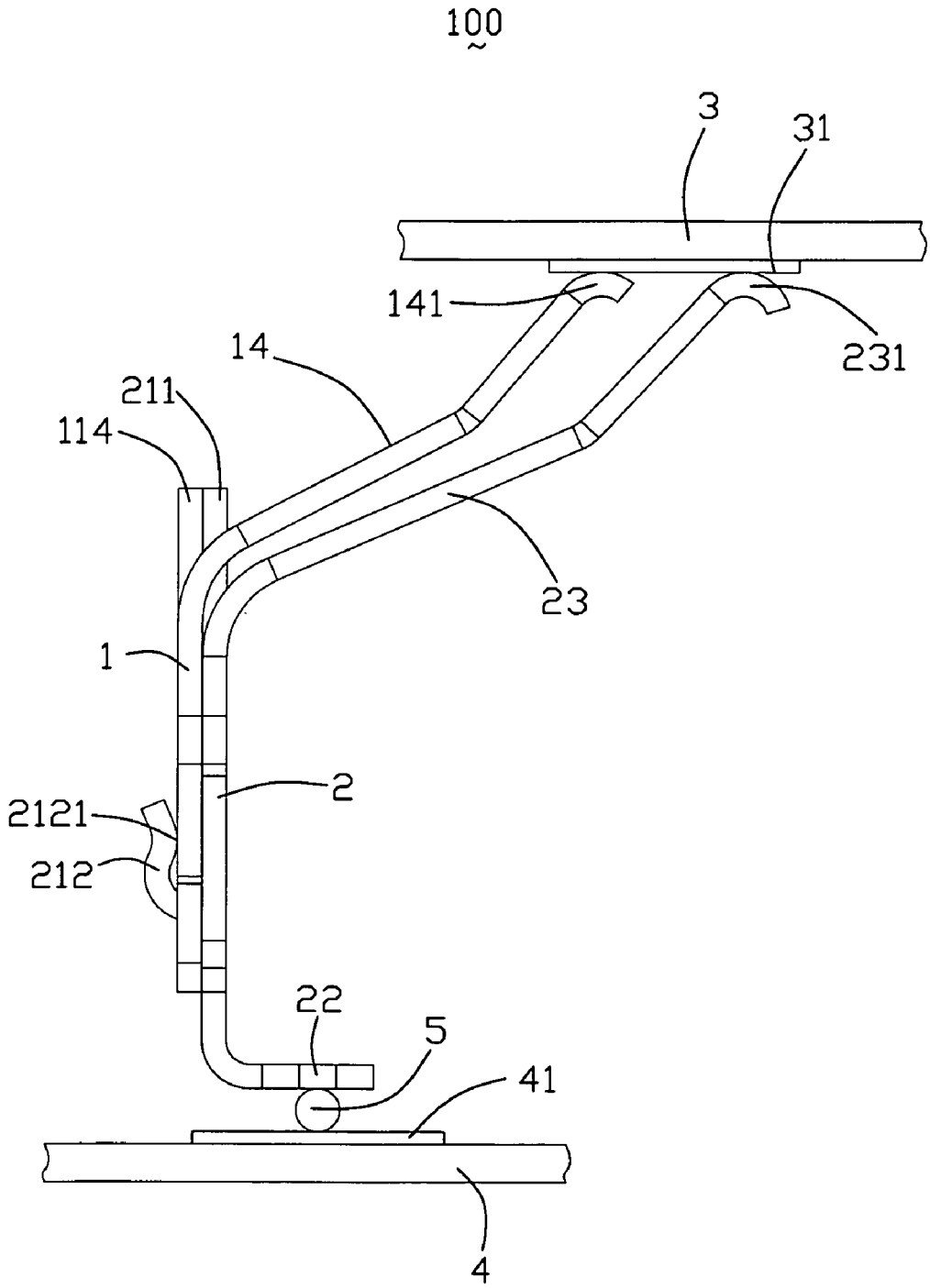
FIG. 3 is a side view of the electrical contact, showing the electrical contact connected with a CPU and a PCB.

Referring to FIG. 1 and FIG. 3, which depict the first embodiment of the present invention. The electrical contact 100 is used for electrically connecting an electronic package, such as a land grid array (LGA) central processing unit (CPU) 3, with a circuit substrate, such as a printed circuit board (PCB) 4. The electrical contact 100 comprises a first part 1 and a second part 2 separated with each other.

The first part 1 comprises a flat body portion 11, a first spring arm 14 extending obliquely from the upper end of the body portion 11, a first extending portion 114 extending upwardly from the upper end of the body portion 11 in a vertical direction and a pair of block portions 12, 13 extending downwardly from the lower end of the body portion 11. The block portions 12, 13 are separated with each other at the lower end. The first spring arm 14 defines a first contacting portion 141 at top end thereof for electrically connecting with the CPU.

The second part 2 comprises a flat retention portion 21, a holding portion 212 extending outwardly from the middle of the retention portion 21, a second spring arm 23 extending obliquely from the upper end of the retention portion 21, a second extending portion 211 extending upwardly from the upper end of the retention portion 21 in a vertical direction and a solder portion 22 extending downwardly from the lower end of the retention portion 21. The solder portion 22 is configured with a flat shape and extending in a horizontal direction. The second spring arm 23 has a second contacting portion 231 at top end thereof for electrically connecting with the CPU. Please referring to FIG. 3, the holding portion 212 is configured with a reversaled S shape and comprises a press portion 2121 for pressing on the body portion 11, thus the body portion 11 of the first part 1 is sandwiched by the pressing portion 2121 and the retention portion 21, then the first part 1 is fastened on the second part 2 securely.

Figure 2:
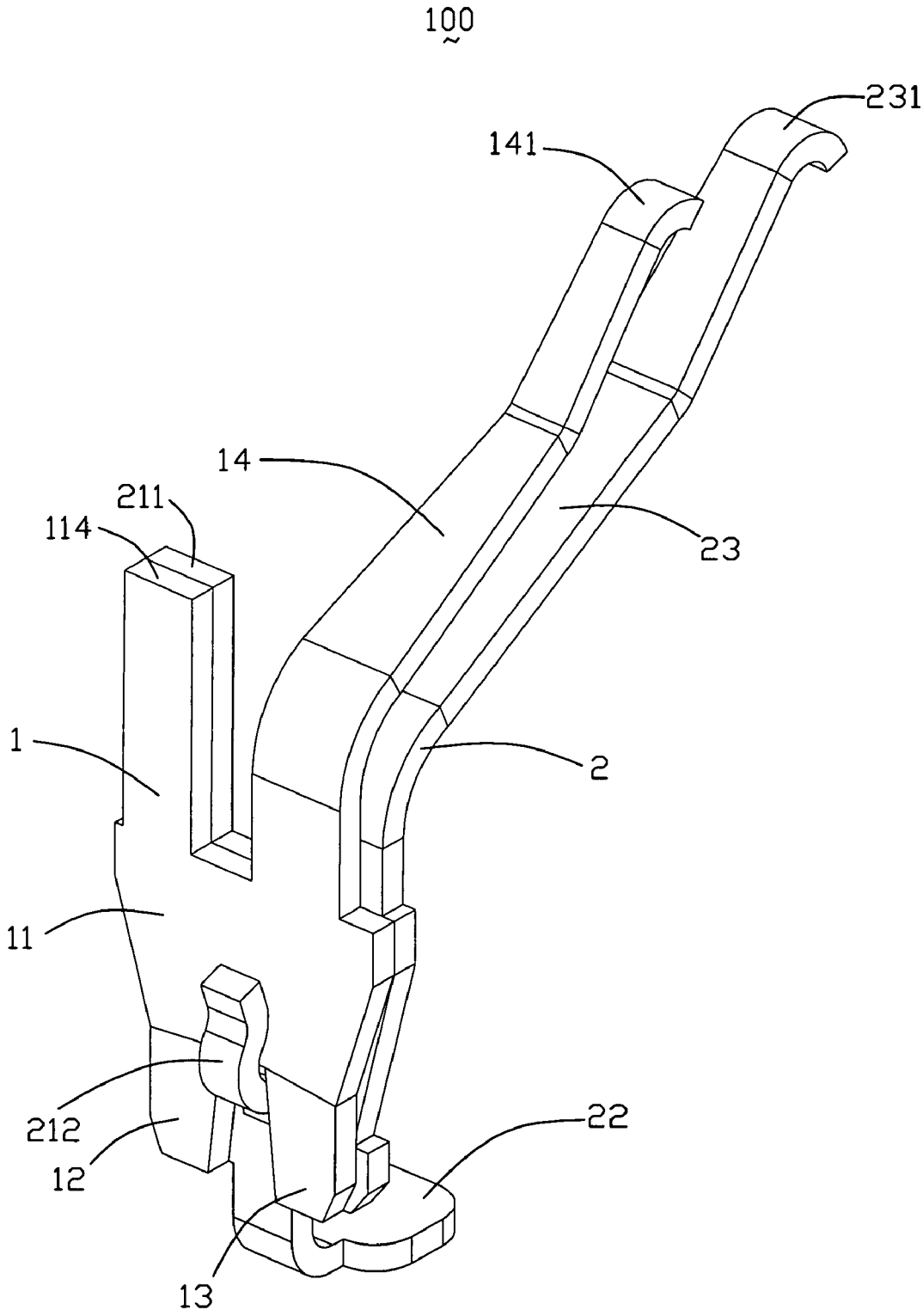
FIG. 2 is an assembled view of the electrical contact in FIG. 1.

Referring to FIGS. 2-3, which shows an assembled view of the electrical contact 100, the body portion 11 of the first part 1 is contact with the retention portion 21 of the second part and is sandwiched by the pressing portion 2121 and the retention portion 21. The pair of block portions 12, 13 are located on the two sides of the holding portion 21, the lower end of the block portions 12,13 are on top of the solder portion 22 and the solder portion 22 is connected to the pad 41 of the PCB 4 through a solder ball 5. The first extending portion 114 and the second extending portion 211 contacts with each other and have the same size. The first spring arm 14 is on top of the second spring arm 23 and the first contacting portion 141 is in the same height with the second contacting portion 231 in the vertical direction and are connected with the same pad 31 of the CPU 3.

Figure 4:
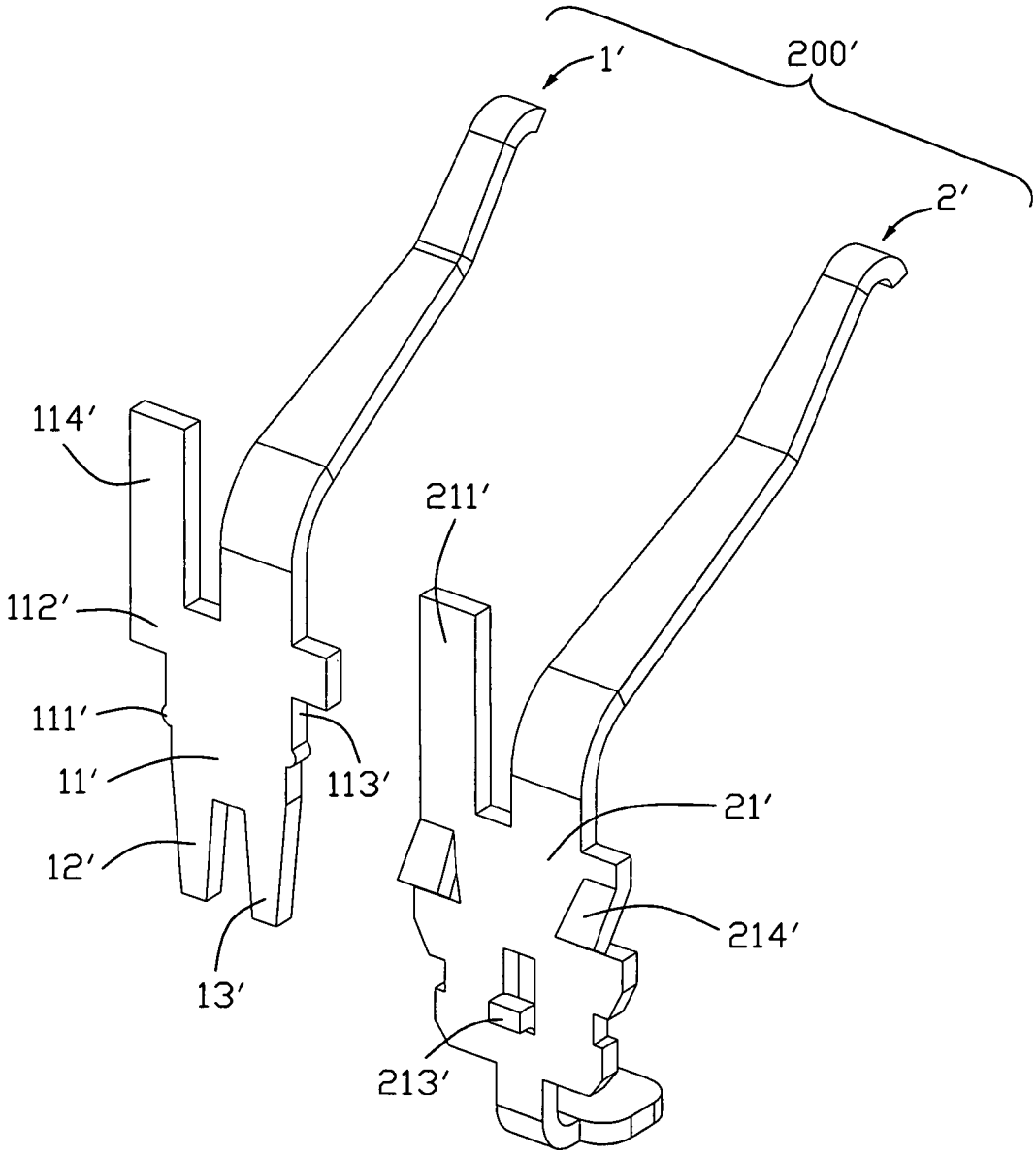
FIG. 4 is an exploded view of an electrical contact in accordance with the second embodiment of the present invention.

Referring to FIG. 4, which depicts a second embodiment of the present invention. In this embodiment, the first part 1' of the electrical contact 200' comprises a pair of shoulder portions 112' and a pair of projections 111' extending laterally from the body portion 11'. The projections 111' is below the shoulder portion 112' and forms a restrict space 113' together with the corresponding shoulder portions 112'. The second part 2' comprises a pair of fasten portions 214' extending outwardly and downwardly from the retention portion 21' and a holding portion 213' extends outwardly from the retention portion 21'.

Figure 5:
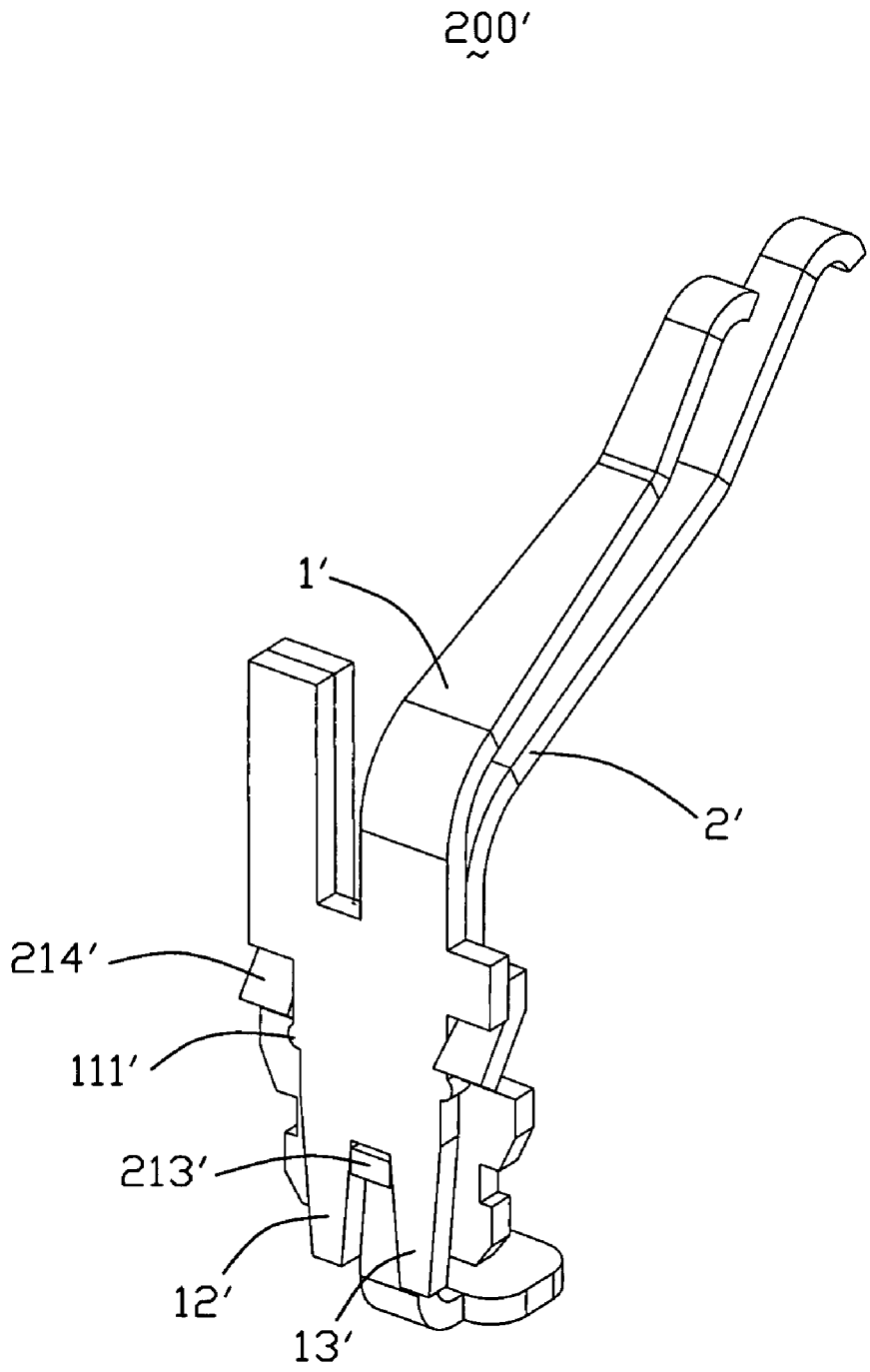
FIG. 5 is an assembled view of the electrical contact in FIG. 4.
Figure 6:
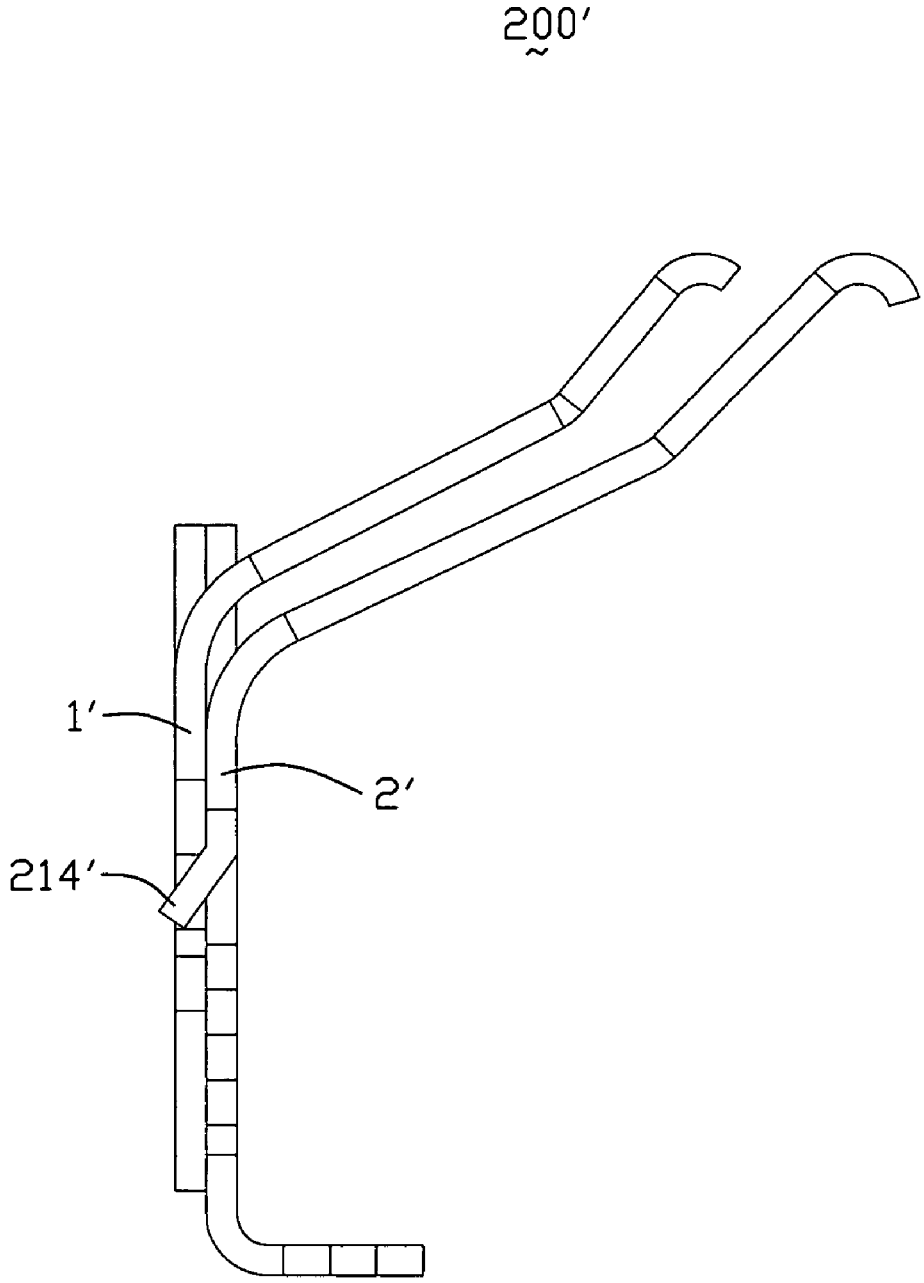
FIG. 6 is a side view of the electrical contact in FIG. 5.

Referring to FIGS. 5-6, showing the assembled view of the electrical contact 200', the body portion 11' of the first part 1' is contact with the retention portion 21' of the second part 2' and the lower end of the body portion 11' is supported by the holding portion 213'. The locking portions 12',13' are located on opposite sides of the holding portion 213', the fasten portions 214' are received in the restrict spaces 113' and engaged with the shoulder portions 112' and the projections 111', thus the first part 1' is fastened on the second part 2' securely.

In the above detailed description, the electrical contact 100, 200' comprises a first part 1, 1' with a first contacting portion 141 and a second part 2, 2' with a second contacting portion 231. The first part 1, 1' is assembled on the second part 2, 2'. Thus the electrical contact 100, 200' can provide at least two contacting portions 141, 231 connecting with the CPU with fewer space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical contact is used for electrically connecting an electronic package, such as a land grid array (LGA), central processing unit (CPU), with a circuit substrate, comprising:

a first part comprising a flat body portion and a first spring arm extending obliquely and forwardly from the body portion, the first spring arm having a first contacting portion at free end thereof; and a pair of block portions separately extending downwardly from the lower end of the body portion thereof for electrically connecting with the CPU; and a second part and the first part being separated from each other; and the second part abutting on the first part, the second part comprising a flat retention portion extending in a vertical direction, a second spring arm extending obliquely and forwardly from the retention portion and a solder portion extending downwardly from the retention portion and extending continuously in a horizontal direction as a flat portion for mounting on the CPU, the second spring arm having a second contacting portion at free end thereof and the body portion being fastened on the retention portion;

the second part comprises a holding portion protruding rearwardly from the retention portion for holding the body portion of the first part onto the retention portion of the second part in a pressing manner.

2. The electrical contact as claimed in claim 1, wherein the first spring arm is on top of the second spring arm, and wherein the first contacting portion and the second contacting portion are located in a horizontal plane.

3. The electrical contact as claimed in claim 1, wherein, the body portion of the second part is used to support the body portion of the first part.

4. The electrical contact as claimed in claim 3, wherein the holding portion comprises a press portion, the body portion of the first part is sandwiched by the press portion and the retention portion of the second part.

5. The electrical contact as claimed in claim 3, wherein the first part comprises a pair of block portions extending downwardly from the body portion and located at opposite sides of the holding portion, the lower end of the block portions are in the upper of the solder portion.

6. The electrical contact as claimed in claim 3, wherein the body portion comprises a pair of shoulder portions and a pair of projections below the shoulder portions.

7. The electrical contact as claimed in claim 6, wherein the second part comprises a pair of fasten portions extending outwardly and downwardly from the retention portion, and the fasten portions are located with the shoulder portions and the projections of the first part.

8. The electrical contact as claimed in claim 6, wherein the first part and the second part each comprises an extending portion extending upwardly from the body portion and the retention portion.

9. An electrical contact is used for electrically connecting an electronic package, such as a land grid array (LGA), central processing unit (CPU), with a circuit substrate, comprising:

a first part comprising a flat body portion and a first spring arm extending obliquely and forwardly from the body portion, the first spring arm having a first contacting portion at free end thereof; and a pair of block portions separately extending downwardly from the lower end of the body portion thereof for electrically connecting with the CPU; and a second part and the first part being separated from each other; and the second part abutting on the first part, the second part comprising a flat retention portion extending in a vertical direction, a second spring arm extending obliquely and forwardly from the retention portion and a solder portion extending downwardly from the retention portion and extending continuously in a horizontal direction as a flat portion for mounting on the CPU, the second spring arm having a second contacting portion at free end thereof and the body portion being fastened on the retention portion; the first spring arm is in the upper of the second spring arm and the first contacting portion is in the same height with the second contacting portion;

the second part comprises a holding portion protruding rearwardly from the retention portion for holding the body portion of the first part onto the retention portion of the second part in a pressing manner.

10. The electrical contact as claimed in claim 9, wherein, the body portion of the second part is used to support the body portion of the first part.

11. The electrical contact as claimed in claim 10, wherein the holding portion comprises a press portion, the body portion of the first part is sandwiched by the press portion and the retention portion of the second part.

12. The electrical contact as claimed in claim 10, wherein the first part comprises a pair of block portions extending downwardly from the body portion and located at opposite sides of the holding portion, the lower end of the block portions are on top of the solder portion.

13. The electrical contact as claimed in claim 10, wherein the body portion comprises a pair of shoulder portions and a pair of projections below the shoulder portions.

14. The electrical contact as claimed in claim 13, wherein the second part comprises a pair of fasten portions extending outwardly and downwardly from the retention portion for engaging with the shoulder portions and the projections of the first part.

15. An electrical contact set is used for electrically connecting an electronic package, such as a land grid array (LGA), central processing unit (CPU), with a circuit substrate, comprising:

a first part comprising a first upstanding main body portion and a first spring arm extending upwardly and obliquely from the body portion, the first spring arm having a first contacting portion at free end thereof; and a second part and the first part being separated from each other; and the second part abutting on the first part, the second part comprising a second upstanding main body portion extending in a vertical direction, a second spring arm extending obliquely and forwardly from the second main body portion and a solder portion extending downwardly from the second main body portion and extending continuously in a horizontal direction as a flat portion for mounting on the CPU, the second spring arm having a second contacting portion at free end thereof and the first body portion being fastened on the second body portion; and only one solder pad unitarily formed on a bottom portion of only one of said first main body and said second main body; wherein the first main body portion and the second main body portion are intimately face to face attached to each other;

at least one of said first part and said second part defines a retention portion for retaining the intimately fastened first and second parts in an insulative housing of an electrical connector.

16. The electrical contact set as claimed in claim 15, wherein an extension angle of said spring arm and that of the second spring arm are different from each other in a side view.

17. The electrical contact set as claimed in claim 15, wherein said first spring arm and said second spring arm are essentially spaced from each other while an upper contact region of the first spring arm and that of the second spring arm are coplanar on a same horizontal plane.

18. The electrical contact set as claimed in claim 17, wherein a distance between said first spring arm and said second spring arm is various under condition that a maximum value occurs between the upper contact regions of said first spring arm and said second spring arm while a minimum value occurs between roots of said first sprint arm and said second spring arm.

19. The electrical contact set as claimed in claim 15, wherein the second spring arm is essentially located under the first spring arm, and the solder pad is formed on the second part.

20. The electrical contact set as claimed in claim 19, wherein the extension angle of the first spring arm is steeper than that of the second spring arm.

* * * * *